US008923537B2

(12) United States Patent
Tipsmark et al.

(10) Patent No.: US 8,923,537 B2
(45) Date of Patent: Dec. 30, 2014

(54) HEARING AID WITH COVER AND PROGRAMMING SOCKET

(71) Applicant: Oticon A/S, Smørum (DK)

(72) Inventors: Claus Tipsmark, Smørum (DK); Søren Wichmann, Smørum (DK); Troels Holm Pedersen, Smørum (DK)

(73) Assignee: Oticon A/S, Smorum (DK)

( * ) Notice: Subject to any disclaimer, the term of this patent is extended or adjusted under 35 U.S.C. 154(b) by 0 days.

(21) Appl. No.: 13/772,706

(22) Filed: Feb. 21, 2013

(65) Prior Publication Data

US 2013/0216077 A1 Aug. 22, 2013

Related U.S. Application Data

(60) Provisional application No. 61/601,574, filed on Feb. 22, 2012.

(30) Foreign Application Priority Data

Feb. 22, 2012 (EP) ..... 12156489

(51) Int. Cl.
*H04R 25/00* (2006.01)

(52) U.S. Cl.
CPC ..... *H04R 25/556* (2013.01); *H04R 25/608* (2013.01); *H04R 25/65* (2013.01); *H04R 2225/61* (2013.01)
USPC ..... 381/314; 381/322; 381/323

(58) Field of Classification Search
CPC ..... H04R 2225/61; H04R 2225/021; H04R 25/556; H04R 25/505; H04R 25/608; H04R 25/602; H04R 25/65; H04R 25/55
USPC ..... 381/58, 60, 314, 322, 323, 324, 327, 381/328, 330, 381, 312
See application file for complete search history.

(56) References Cited

U.S. PATENT DOCUMENTS

| | | | | |
|---|---|---|---|---|
| 4,961,230 | A * | 10/1990 | Rising | 381/323 |
| 5,500,901 | A * | 3/1996 | Geraci et al. | 381/323 |
| 7,443,992 | B2 * | 10/2008 | Fideler | 381/328 |
| 2007/0036380 | A1 | 2/2007 | Kral et al. | |
| 2009/0042426 | A1 | 2/2009 | Kramer | |
| 2011/0170722 | A1 | 7/2011 | Brimhall et al. | |

FOREIGN PATENT DOCUMENTS

| | | | |
|---|---|---|---|
| DE | 102008060057 | A1 | 6/2010 |
| WO | WO 2010/108543 | A1 | 9/2010 |

* cited by examiner

*Primary Examiner* — Huyen D Le
(74) *Attorney, Agent, or Firm* — Birch, Stewart, Kolasch & Birch, LLP

(57) ABSTRACT

A hearing aid with a housing holding a microphone, a battery, a programmable signal processing device capable of delivering an output signal is provided whereby the output signal drives an output transducer of the hearing aid to serve a stimulus on the hearing aid user perceivable as sound. The hearing aid housing further holds a socket adapted for receiving a programming connection in order to connect the programmable signal processing device to an external programming device, and a switch adapted to be operated by the hearing aid user, and a cover arranged above the socket and switch and pivotally linked to the hearing aid. Preferably an intermediate link is provided and adapted to interlink the hearing aid with the cover.

7 Claims, 5 Drawing Sheets

HEARING AID WITH COVER AND PROGRAMMING SOCKET

CROSS REFERENCE TO RELATED APPLICATIONS

This non-provisional application claims the benefit of U.S. Provisional Application No. 61/601,574 filed on Feb. 22, 2012 and to Patent Application No. 12156489.2 filed in the European Patent Office on Feb. 22, 2012. The entire content of all of the above applications is hereby incorporated by reference.

The invention concerns a hearing aid having a programming connector adapted to receive a jack to allow electrical wired communication between the signal processing device and a programming device outside the hearing aid with the view to program the signal processing device according to the hearing aid user hearing loss and other needs.

BACKGROUND OF THE INVENTION

In such hearing aid systems the programming connector may be provided behind a separate lid element. Such a lid may become very small and difficult for the user to open, and as a result a bigger lid is desired. However easy such a lid may be made, it inevitably will make the hearing aid more conspicuous. It is known to provide a lid element where under also a switch is provided, and which may be snapped on or off the hearing aid. This solution is not well liked by the users, as the small lid part is prone to become missing due to its small size. Also it is known to pivotally hinge such a lid onto the hearing aid at one end thereof, however when simply pivotally linked to the hearing aid, the lid may well not be able to pivot sufficiently out of the way for the programming connector to be readily attached to the socket.

SUMMARY OF THE INVENTION

The object of the invention is to provide a hearing aid with a programming socket, which is readily contactable and whereby a lid or cover element, grants access to the programming socket without being disconnected from the hearing aid.

Thus a hearing aid with a housing holding a microphone, a battery, a programmable signal processing device capable of delivering an output signal which may drive an output transducer of the hearing aid to serve a stimulus on the hearing aid user perceivable as sound is provided, the hearing aid housing further holding a socket adapted for receiving a programming connection adapted to connect the programmable signal processing device to an external programming device, and a cover arranged above the socket, and pivotally linked to the hearing aid. An intermediate link is provided and adapted to interlink the hearing aid with the cover. This intermediate link allows the cover to be translated away from the socket while still being linked to the hearing aid, whereby the user does not risk loosing this part during programming of the hearing aid. Further, the link ensures that the cover is removed from the vicinity of the programming socket, and will thereby not interfere with the use of the programming socket. Preferably the intermediate link may at a proximal end thereof be pivotally fastened to the hearing aid and at the distal end thereof be pivotally fastened to the cover. This way of tethering the cover to the hearing aid allows the distal end of the intermediate link to translate along a circular path with respect to the hearing aid while the cover retains a rotational degree of freedom around distal end of the intermediate link.

A switch is provided below the cover adjacent to the socket. The switch is operable by pressure and the cover is adapted to transfer pressure from a user's finger to the switch. In this way the cover serves both as cover over the programming socket and as a push button for effecting transferring pressure to the switch.

The cover may further include a snap lock arranged to snap in and out of engagement with a corresponding snap in the hearing aid. In this way, the cover may be lifted off and re-attached to the hearing aid any number of times using simple means.

The snap lock of the cover and the corresponding snap in the hearing aid may be arranged as a hinge and corresponding hinge pin to allow pivotal movement of the cover with respect to the hearing aid when the cover is snapped onto the hearing aid. If the hinge is part of the cover, preferably it may comprise two opposed stubs having a recess on facing sides, intended to receive the hinge pin.

The hinge pin may be fastened to the hearing aid and the pivotal fastening of the proximal end of the intermediate link in the hearing aid may be arranged coaxially with the axis of the hinge pin, such that the intermediate link and the cover may both revolve around the hinge pin axis. In this way it is ensured, that the intermediate link will not interfere with the pivotal movement of the cover when the cover is used to work the switch.

The cover may at a first end thereof be adapted for interaction with the switch and at a second end thereof comprise a linking means for establishing a pivotal link with the link element and further, the cover may, between the first and the second end thereof, comprise the snap lock shaped to releaseably and rotate-ably snap onto the hearing aid. Hereby the cover may attach to and revolve around the same axis of rotation which is utilized by the link element in the hearing aid, while at the same time the link element attaches to the cover at a further attachment point. The cover and the link element will thus rotate in unison around the hinge pin when the cover is used as push button by the hearing aid user.

The invention also prescribes a method of programming a hearing aid of the above kind. According to the method a cover may be pried off a snap connection with a hearing aid and translated, while linked by an intermediate link to the hearing aid, the intermediate link being rotated around a pivotal connection point with the hearing aid. Hereby an access opening to a programming socket may be revealed, and further a programming connector may be attached to the programming socket and programming signals may be served at the hearing aid. In a further step the programming connector may be removed and further the cover may be translated by rotating the intermediate link, in order to position a snap lock of the cover aligned with corresponding snap in the hearing aid and lastly the cover may be pushed onto the hearing aid bringing the snap lock into engagement with the snap in the hearing aid.

By using this programming method, it is ensured that the cover remains attached to the hearing aid during programming, and it will thus be easy to re-establish the function of the cover by simply translating it back into place and pressing it into engagement with the snap connection of the hearing aid.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF THE DRAWINGS

The figures are schematic and simplified for clarity, and they just show details which are essential to the understanding of the invention, while other details are left out. Throughout, the same reference numerals are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF A PREFERRED EMBODIMENT

Figure 6:
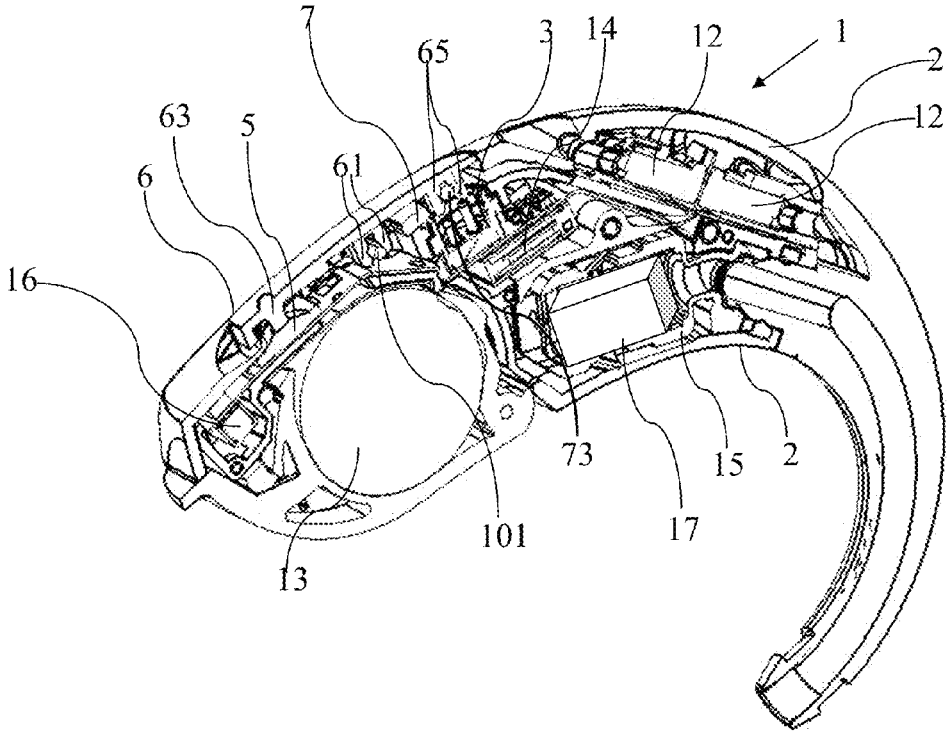
FIG. 6 is a section through a hearing aid shown in a partial elevated projection.

A hearing aid 1 with a housing 2 is shown in FIG. 6. Inside the housing 2 a microphone 12, a battery 13 and a programmable signal processing device 14 is provided. The signal processing device 14 is coupled electrically to the transducers, microphones 12, speaker suspension 15, antennas 16, switches 5 and battery 18 in the usual manner, and capable of delivering an output signal which drives an output transducer, in this case a speaker 15. The output transducer will serve a stimulus on the hearing aid user perceivable as sound. This stimulus could be direct electrical stimulus of nerve tissue, vibrational stimulus or sound travelling through air to the tympanic membrane as in the current example. The hearing aid housing 2 further holds:

- a socket 3 adapted for receiving a programming connection 4 (shown in FIGS. 2 and 3) in order to link the programmable signal processing device 14 to an external programming device 19,
- a switch 5 adapted to be operated by the hearing aid user,
- a cover 6 arranged above the socket 3 and switch 5.

The cover 6 is pivotally linked to the hearing aid 1, such that pushing down on one end 62 of the cover 6 will cause it to pivot and transfer movement to the switch 5 in order to operate the switch 5.

A number of further elements may be included in the hearing aid housing according to customary practise in order to establish a working hearing aid, but are not named as it would not facilitate the understanding of the invention.

Figure 1:
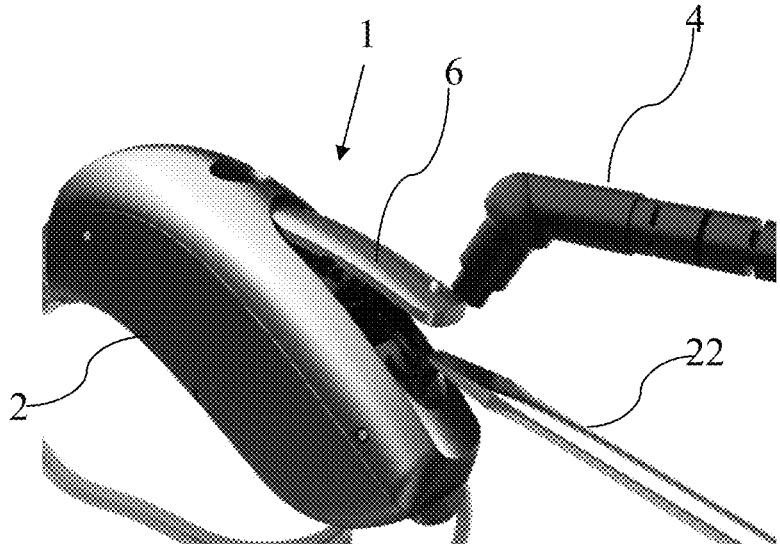
FIG. 1 shows a computer representation of a hearing aid and programming connector, with the cover pried partially away from the hearing aid.

As seen in FIG. 1, the cover 6 may be pried away from the housing 2 by use of some pointed implement, such as a screwdriver 22, however an intermediate link 7 is provided between the hearing aid 1 and the cover 6. By means of this link 7 the cover 6 still remains attached to the hearing aid housing 2, while the programming socket 3 becomes available for the attachment of the programming connection 4. This connection is an ordinary jack with a number of electric connection elements fitting the socket 3. It is customary in hearing aids that the socket in the hearing aid comprises a number of separate metal pins, arranged to be engaged by holes in the jack, the holes being lined with metal linings thus creating good electrical contact between the pins in the socket and the metal linings in the socket. The pins in the socket are arranged to gain contact with the circuitry of the hearing aid, and the linings in the holes are arranged to connect to leads in a wire 23, which is connected to an external programming device 19 such as a computer or the like.

Figure 2:
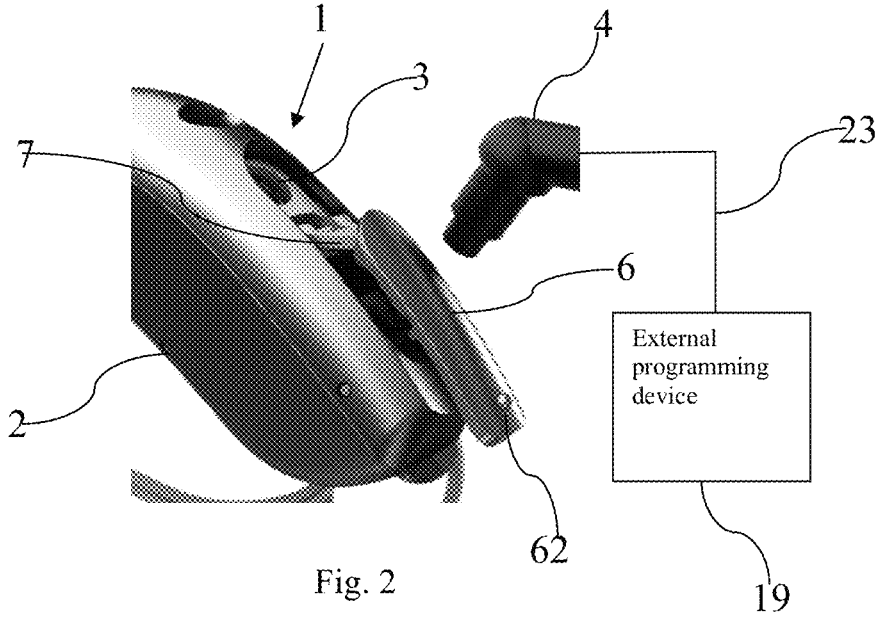
FIG. 2 shows the hearing aid and connector, but now with the cover translated to expose the programming socket.
Figure 3:
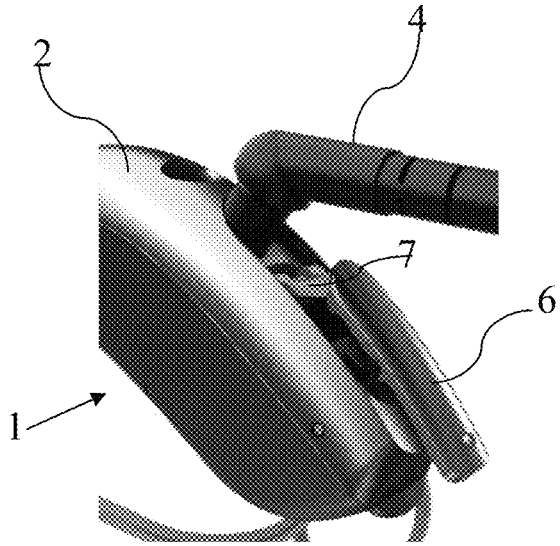
FIG. 3 shows the hearing aid and connector with the programming connector attached.

The link 7 has a proximal end 71 which is pivotally fastened to the hearing aid 1 and a distal end 72 which is pivotally fastened to the cover 6, such that the cover 6 may translate along a circular path with respect to the hearing aid 1. This is illustrated in FIG. 1 and FIG. 2. Also the connection between the cover and the distal end of the link 7 is a pivotal connection such that the cover may pivot around this connection, which is illustrated in FIG. 1.

Also the cover further include a snap lock 61 arranged to snap in and out of engagement with a corresponding snap 101 in the hearing aid. This allows the cover 6 to be pried off and pushed back onto the hearing aid 1 any number of times.

Figure 5:
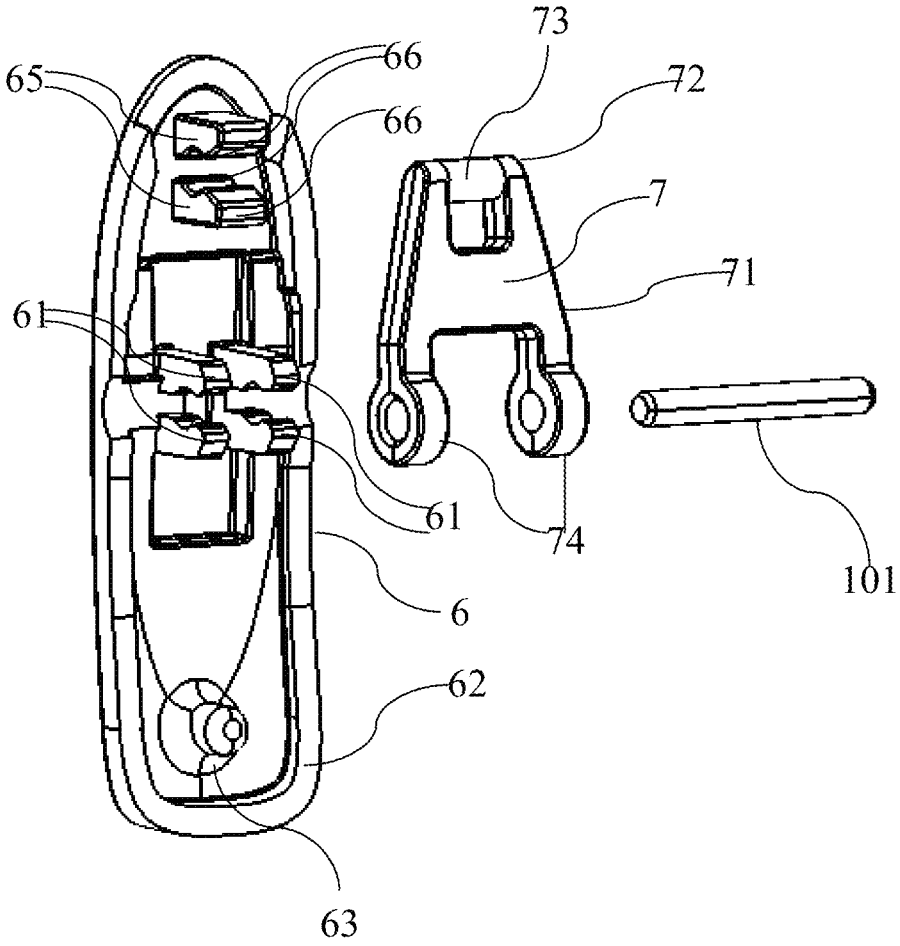
FIG. 5 is an exploded view of the cover and link part, seen from the underside.

As seen in FIG. 5 the snap lock 61 of the cover 6 and the corresponding snap 101 in the hearing aid 1 are arranged as a hinge 61 and corresponding hinge pin 101 to allow pivotal movement of the cover 6 with respect to the hearing aid when the cover is snapped onto the hearing aid. Thus the cover is movably mounted to the hearing aid, such that by pressing it towards the hearing aid 1, it may pivot and transfer the movement onto the switch 5 in order to operate it.

Accordingly the hinge pin 101 is fastened to the hearing aid 1. Also, the pivotal fastening in the hearing aid of the proximal end 71 of the link 7 is arranged coaxially with the axis of the hinge pin 101. In this way the intermediate link and the cover may revolve in unison around the axis of the hinge pin 101.

Figure 4:
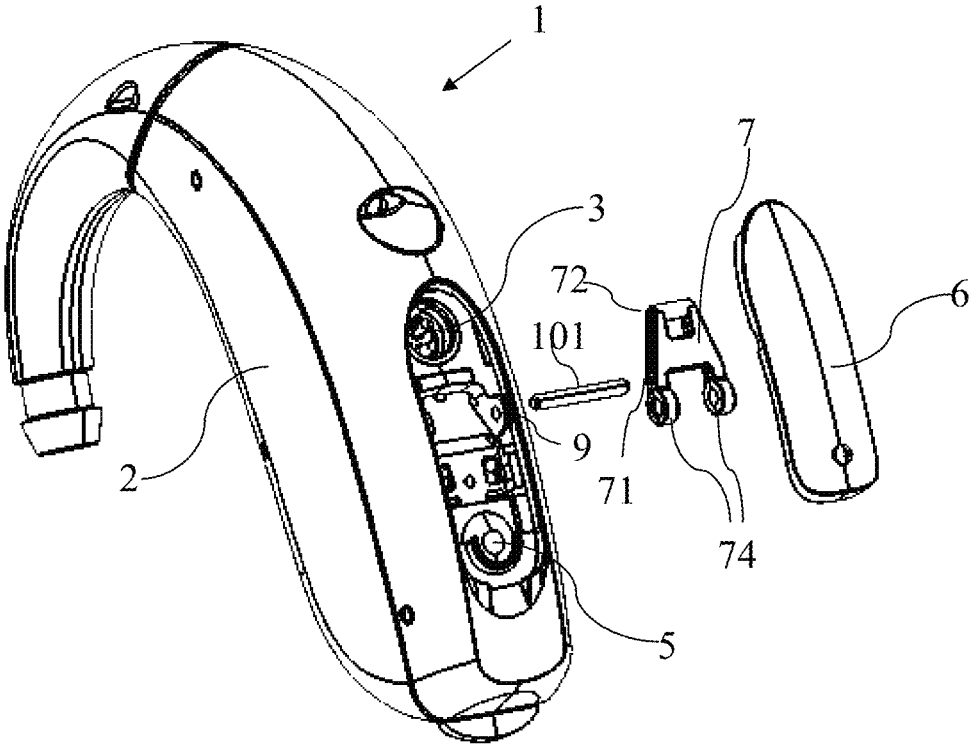
FIG. 4 shows an exploded view of the hearing aid and cover.
Figure 7:
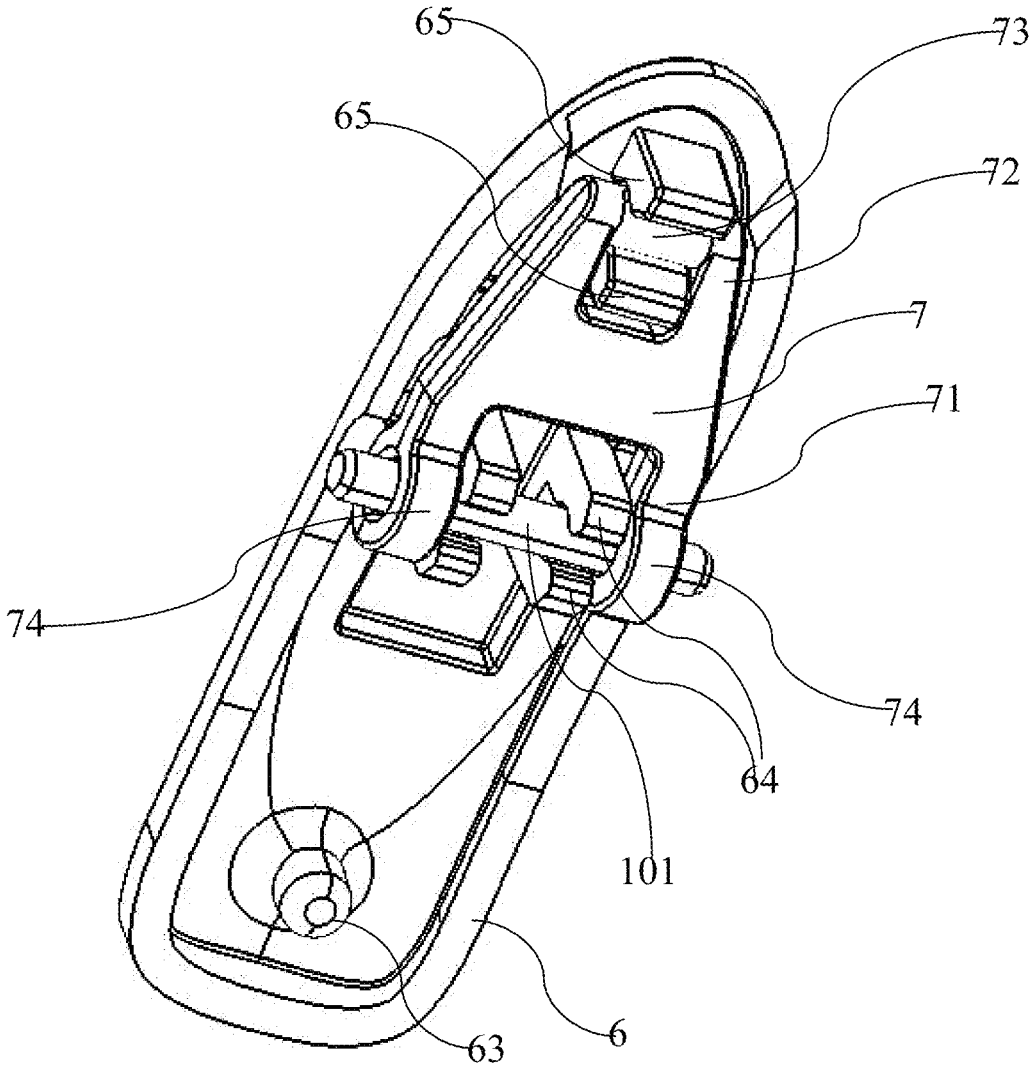
FIG. 7 shows the cover and link when assembled in an elevated projection from below.

The cover 6 has at a first end 62 thereof a protrusion 63 which is adapted for interaction with the switch 5 when the cover 6 is seated correctly in the hearing aid 1. At a second end 64 of the cover 6, linking means 65 are provided for establishing a pivotal link with the distal end 72 of link element 7. To this end the linking means 65 are established as opposed stubs 65 having opposed indents 66 whereby the stubs may function as snap lock element shaped to receive an axle part 73 shaped integrally with the distal end 72 of the link element 7. On the cover 6, between the first end 62 with the protrusion 63 and the second end with the linking means 65 the snap lock 61 is provided. This lock 61 is intended to relesably and rotatably snap onto the hinge pin 101 of the hearing aid 1. As seen in FIG. 7 when the cover 6 is connected with the intermediate link 7 at both ends thereof, the two will form a body which will move in unison around the hinge pin 101. The hinge pin 101 is rotatably attached to the link element 7, as the link element at the proximal part 71 thereof comprises two bearings 74 shaped to accommodate the hinge pin 101. The hinge pin 101 is seated in the hearing aid by similar bearings 9 of which one is visible in FIG. 4.

The invention claimed is:

1. Hearing aid with a housing holding a microphone, a battery, a programmable signal processing device capable of delivering an output signal adapted to drive an output transducer of the hearing aid to serve a stimulus on the hearing aid user perceivable as sound, the hearing aid housing further holding a socket adapted for receiving a programming connection adapted to link the programmable signal processing device to an external programming device, and a movable cover above the socket pivotally linked to the hearing aid, whereby an intermediate link is provided and adapted to interlink the hearing aid with the cover in that the intermediate link at a proximal end thereof with respect to the hearing aid is pivotally fastened to the hearing aid and at the distal end thereof is pivotally fastened to the cover.

2. Hearing aid as claimed in claim 1, wherein a switch is provided below the cover adjacent to the socket, the switch being operable by pressure and whereby the cover is adapted to transfer a user's pressure to the switch.

3. Hearing aid as claimed in claim 1, wherein the cover further includes a snap lock arranged to snap in and out of engagement with a corresponding snap in the hearing aid.

4. Hearing aid as claimed in claim 3, wherein the snap lock of the cover and the corresponding snap in the hearing aid are arranged as a hinge and corresponding hinge pin to allow pivotal movement of the cover with respect to the hearing aid when the cover is snapped onto the hearing aid.

5. Hearing aid as claimed in claim 4, wherein the hinge pin is fastened to the hearing aid, and the pivotal fastening of the proximal end of the intermediate link in the hearing aid is arranged coaxially with the axis of the hinge pin, such that the intermediate link and the cover may both revolve around the hinge pin axis.

6. Hearing aid as claimed in claim 5, wherein the cover at a first end thereof is adapted for interaction with the switch and at a second end thereof has linking means for establishing a pivotal link with the link element and between the first and the second end thereof the cover comprises the snap lock intended to releasably and rotably snap onto the hearing aid.

7. A method of programming a hearing aid, the method comprising:

prying a cover off a snap connection with the hearing aid;

translating said cover while the cover is linked by an intermediate link to the hearing aid, the intermediate link having a proximal end rotationally hinged at a pivotal connection point of the hearing aid and a distal end rotationally hinged on said cover, wherein said translating includes rotating the intermediate link around the pivotal connection point with the hearing aid, and rotating the cover around the distal end of the intermediate link, said rotating translating revealing an access opening to a programming socket;

attaching a programming connector to the programming socket;

programming the hearing aid via the programming connector;

removing the programming connector from the programming socket;

translating the cover by rotating the intermediate link to position a snap lock of the cover into alignment with a corresponding snap in the hearing aid; and pushing the cover onto the hearing aid to bring the snap lock into engagement with the snap.

* * * * *